US005141408A

United States Patent [19]

Conrad et al.

[11] Patent Number: 5,141,408

[45] Date of Patent: Aug. 25, 1992

[54] PRODUCT PUMPING APPARATUS

[75] Inventors: Roger N. Conrad, Geneva, Ill.; Albert Krueger, Gig Harbor, Wash.; Richard A. Baldwin, Englewood; Daniel R. Simons, Evergreen, both of Colo.; James M. Savina, Olathe, Kans.

[73] Assignee: PRC, Englewood, Colo.

[21] Appl. No.: 612,004

[22] Filed: Nov. 9, 1990

[51] Int. Cl.[5] ..... F04B 35/02

[52] U.S. Cl. ..... 417/339; 417/489; 417/900

[58] Field of Search ..... 417/339, 900, 489

[56] References Cited

U.S. PATENT DOCUMENTS

| | | | |
|---|---|---|---|
| 1,723,874 | 8/1929 | Lunge . | |
| 2,010,377 | 8/1935 | Sassen | 103/213 |
| 2,238,944 | 4/1941 | Muller et al. | 417/900 |
| 3,108,318 | 10/1963 | Miller et al. | 17/39 |
| 3,456,285 | 7/1969 | Miller et al. | 17/39 |
| 3,473,189 | 10/1969 | Middleton . | |
| 3,816,029 | 6/1974 | Bowen et al. | 417/223 |
| 3,847,507 | 11/1974 | Sakiyama et al. | 417/22 |
| 4,097,962 | 7/1978 | Alley et al. | 17/39 |
| 4,140,437 | 2/1979 | Faldi | 417/900 |
| 4,140,443 | 2/1979 | Olson | 417/900 |
| 4,191,309 | 3/1980 | Alley et al. | 222/1 |
| 4,343,598 | 10/1982 | Schwing et al. | 417/900 |
| 4,359,312 | 11/1982 | Funke et al. | 417/18 |
| 4,543,044 | 9/1985 | Simmons | 417/900 |
| 4,637,936 | 1/1987 | White et al. | 426/523 |
| 4,674,267 | 6/1987 | Szemplenski et al. | 53/432 |
| 4,691,411 | 9/1987 | Higashimoto | 17/49 |
| 4,700,899 | 10/1987 | Powers et al. | 241/30 |
| 4,747,342 | 5/1988 | Schack et al. | 99/472 |
| 4,780,931 | 11/1988 | Powers et al. . | |
| 4,830,230 | 5/1989 | Powers | 222/334 |
| 5,024,584 | 6/1991 | Bordini et al. | 417/900 |

FOREIGN PATENT DOCUMENTS

| | | |
|---|---|---|
| 189531 | 4/1957 | Austria . |
| 1289760 | 2/1969 | Fed. Rep. of Germany . |
| 2065829A1 | 3/1976 | Fed. Rep. of Germany . |
| 2843624 | 8/1979 | Fed. Rep. of Germany . |
| 2426561 | 12/1979 | France . |
| 1331459A1 | 8/1987 | U.S.S.R. . |

*Primary Examiner*—Richard A. Bertsch
*Assistant Examiner*—Charles G. Freay
*Attorney, Agent, or Firm*—Sheridan Ross & McIntosh

[57] ABSTRACT

A dual piston alternately reciprocating pumping apparatus utilizing, in part, a pressure based precompression stroke to provide product at a substantially uniform discharge pressure. In operation, a first feed piston is advanced through a first feed cylinder to discharge product therefrom, during which time a second feed piston is retracting within a second feed cylinder to obtain a product charge therein. The second feed piston reaches bottom dead center and thereafter advances through the second feed cylinder on a precompression stroke, during which no product is discharged from the second feed cylinder. After a predetermined pressure related to that within the second feed cylinder is detected, further advancement of the second feed piston is terminated and is not reactivated until the first feed piston nears top dead center. Therefore, a product having a substantially uniform discharge pressure is provided.

23 Claims, 11 Drawing Sheets

PRODUCT PUMPING APPARATUS

FIELD OF THE INVENTION

The present invention relates generally to the field of pumping apparatuses and, more particularly, to reciprocating pumping apparatuses designed for supplying food-related products at a substantially constant pressure to food packaging, processing, or other similar equipment.

BACKGROUND OF THE INVENTION

Numerous types of pumps having a plurality of features directed to improving performance of the pump for one or more specific applications are currently available on the market today. One application where pumps have evolved significantly to address the needs of the industry are those which are designed to transport food-related products such as ground meat, emulsifications, stews, etc. When pumps of this type supply such products to packaging or other processing equipment positioned downstream from the pump, it is often important that the pump supply a substantially continuous flow of product at a predetermined, constant pressure. This ensures, for instance, that constant weights of packaged product are provided since packaging machines often operate on a timed basis.

A popular type of pump particularly suitable for use with food-related products is the reciprocating pump. One type of reciprocating pump utilizes a single piston and cylinder configuration. Typically, this pump will interact with a source of product such that a charge of product will be drawn into the cylinder on the piston's intake stroke and then discharged from the cylinder on the piston's discharge stroke. As is readily apparent, when using only a single piston it is impossible to maintain a constant flow of product under a uniform pressure since discharge only occurs during one-half of the piston's cycle.

In order to compensate for the lack of discharge over one-half of a typical single piston reciprocating pump's cycle, dual or multi-piston configurations have been devised. U.S. Pat. No. 3,108,318 to Miller et al. ("Miller I"), issued Oct. 29, 1963, is representative of this particular type of reciprocating pump. Miller I generally discloses a horizontal dual piston configuration in which one piston and its associated cylinder alternately reciprocate with a second piston and its associated cylinder to pump food products through a common discharge manifold. The disclosure indicates that both the first piston and its cylinder retract so that product may enter into a discharge chamber. After fully retracting, the first cylinder advances through the discharge chamber to trap a charge of product while the first piston stalls momentarily in its retracted position. After the first cylinder has properly seated against the end of the discharge chamber, the first piston advances through the cylinder to discharge the product therefrom. The second piston and its cylinder proceed under the same cycle, but the timing associated with the movement of the second piston and its cylinder is such that the second piston and cylinder are 180° out-of-phase in relation to movement of the first piston and its cylinder. Consequently, when the first piston is discharging product, the second piston and cylinder are retracting to receive a charge of product in the discharge chamber. This dual piston configuration and the timing of their reciprocation thus produces a more uniform flow and pressure at discharge.

Alternately reciprocating dual piston pumps improve both the uniformity of the flow rate and the product pressure at discharge. However, pressure drops and decreases in flow rate discharge still occur since there is often a slight delay between the end of the discharge stroke of the first piston and the start of the discharge stroke of the second piston. In order to achieve consistent weights in packaged foods, it is important that such variations be reduced to acceptable levels. Consequently, numerous refinements of dual piston configurations have been proposed.

U.S. Pat. No. 3,456,285 to Miller et al. ("Miller II"), issued Jul. 22, 1969, discloses one type of alteration of a dual piston alternately reciprocating pump. Miller II generally discloses a horizontal dual piston pump in which both the pistons and their respective cylinders reciprocate as disclosed in Miller I discussed above. However, Miller II incorporates a number of additional features. For instance, the pistons and cylinders are positioned below a hopper which includes paddles to assist in forcing product down into the discharge area through which the cylinders pass to trap a charge of product. Furthermore, the cycles of the pistons overlap, which is achieved by driving the pistons with low and high pressure hydraulics. High pressure hydraulic fluid is used to drive the first piston through its cylinder to discharge product while the second piston and cylinder are being retracted. When fully retracted, the second cylinder is advanced through the discharge area to obtain a charge of product. After sealing of the charge by the second cylinder is completed, the second piston is advanced within the cylinder by low pressure hydraulic fluid. However, no product is discharged from the second cylinder since a valve positioned in the manifold connecting the outlets from the two cylinders only accepts flow from one cylinder at a time, that being the cylinder under the highest pressure. After the first piston completes its discharge stroke, high pressure hydraulic fluid is applied to the second piston to initiate its discharge stroke while the first piston and cylinder are retracted to complete the cycle which is thereafter repeated.

U.S. Pat. No. 4,191,309 to Alley et al., issued Mar. 4, 1980, discloses a product portioning or metering assembly used in combination with a pumping apparatus similar to that disclosed by Miller II. The disclosure of Alley et al. Illustrates, however, a number of variations in pump operations. For instance, the initial advancement of the first piston from its retracted position under the low pressure hydraulic fluid as the second piston is performing its discharge stroke under the high pressure hydraulic fluid is said to provide "precompression" which permits accurate metering of the product to be dispersed by removing air pockets therefrom prior to discharge. Presumably, this movement of the piston is termed as "precompression" since only low pressure hydraulic fluid is being applied to the first piston, and thus no product is discharged from its associated cylinder since discharge occurs only from the cylinder under the highest pressure. The precompression stroke continues until the low pressure hydraulic fluid is unable to overcome the increasing pressure within the cylinder as a result of compression of the product, at which point the first piston stalls. After the second piston completes its discharge stroke, high pressure hydraulic fluid is applied to the first piston, which remained in the stalled position by continually receiving the low pressure hydraulic fluid, to initiate its discharge stroke as the second piston and cylinder retract to repeat the above cycle.

U.S. Pat. No. 4,691,411, to Higashimoto, issued Sep. 8, 1987, discloses a dual piston alternately reciprocating pump which also incorporates a precompression stroke. This particular pump is a vertical pump which includes a hopper positioned above two feed cylinders, each of such cylinders having a reciprocating piston contained therein. A shutter plate is positioned between each cylinder and the hopper to essentially function as an inlet valve to the cylinders and the pistons move alternately within the cylinders through essentially intake and discharge strokes so as to provide a substantially uniform discharge of product. However, the pump also includes a precompression stroke to further refine the pressure variation at discharge. After a piston has reached bottom dead center ("BDC") and the shutter plate for the respective cylinder is closed, the piston advances through the cylinder on a precompression stroke which continued for a pre-determined time established by a time, regardless of the pressure attained in the cylinder during such precompression. After the lapse of the pre-determined time, further movement of the piston is terminated by the drive assembly, thereby completing the precompression stroke. Just prior to the time in which the other piston completes its discharge stroke, signal is sent to the drive assembly for the stalled piston to initiate its discharge stroke. After the lapse of a predetermined time, the other piston retracts on its intake stroke to complete the cycle. Although precompression is used by Higashimoto, its benefits are limited by the precompression stroke being defined by a pre-set time. Since different charges may possibly be obtained on each stroke when certain products are being pumped or with variations in pump speed, a time-dependent precompression stroke might not produce a consistent precompression pressure. This precompression pressure variation would adversely affect the pressure variation ar discharge.

U.S. Pat. No. 4,700,899 to Powers et al., issued Oct. 20, 1987, discloses another refinement of a dual piston alternately reciprocating pump. The general structure and operation or the pump disclosed by Powers et al. is similar to that disclosed by Miller I and II and Alley et al., utilizing two reciprocating pistons and cylinders. The heads of the pistons, however, are modified in that they incorporate a plurality of apertures through which a vacuum is drawn as the pistons are retracted on their respective intake strokes. This vacuum is maintained as the cylinder sleeves are propelled through the discharge chamber to allegedly assure full deaeration of the product.

Providing a pulsation free flow (i.e. free of deviation in discharge pressure), has of course not been limited to pumps used in the food industry. Reciprocating pumps have been designed to provide a pulsation free delivery of a liquid by a variety of methods. For instance, U.S. Pat. No. 4,359,312 to Funke et al., issued Nov. 16, 1982, allegedly provides a pulsation free delivery of a liquid from a dual piston alternately reciprocating pump by incorporating a feedback system which utilizes sensors positioned on the common discharge to ultimately adjust the speeds of the pistons, including adjustments which compensate when liquid is discharged simultaneously from both cylinders. U.S. Pat. No. 3,847,507, to Sakiyama et al., issued Nov. 12, 1974, discloses a feedback circuit for a single reciprocable piston (although reference is made to utilizing two pistons if a higher flow output is required) which uses a pressure sensor within the cylinder to activate a motor to move the piston within the cylinder to maintain a constant pressure on the discharged liquid. U.S. Pat. No. 1,723,874 to Lunge, issued Aug. 6, 1929; U.S. Pat. No. 2,010,377 to Sassen, issued Aug. 6, 1935; and U.S. Pat. No. 3,816,029 to Bowen et al., issued Jun. 11, 1974, each generally pertain to attempting to provide pulsation free delivery of a liquid by using specially designed cams to drive the pistons in a timed relation. The complexity of these types of apparatuses, as well as the results achieved, however, makes them somewhat undesirable for use in food-related applications.

SUMMARY OF THE INVENTION

The present invention generally relates to an improved dual piston alternately reciprocating pumping apparatus for providing a substantially uniform product pressure at discharge. Consequently, the present invention is particularly advantageous for use in combination with packaging or processing equipment for food-related products in which it is desirable to receive precise amounts of product under a substantially uniform pressure and density.

One embodiment of the present invention generally includes three primary components, namely a hopper for supplying product to the actual pumping apparatus, a cylinder housing containing at least two feed cylinders, each cylinder having a single feed piston reciprocally positioned therein, and a drive assembly for generally alternately reciprocating the feed pistons. The hopper is preferably positioned above the cylinder housing such that product may gravitate from the hopper into the respective feed cylinders at the appropriate time. In this regard, a reciprocating shutter plate is positioned between each feed cylinder and the hopper to regulate flow into the feed cylinders in a timed fashion which properly coincides with the reciprocation or the feed pistons as discussed below. These shutter planes thereby function essentially as an intake valve for the feed cylinders, whereas a discharge outlet positioned in the upper portion of each feed cylinder functions as the exhaust valve to allow product to be discharged therefrom into a common manifold connecting the outlets. The discharge outlet for each feed cylinder is preferably slot-shaped so as to extend around a portion of the circumference of the feed piston and also tapers inwardly from the cylinder wall to the location where it connects to the common manifold. Although the discharge outlets are not directly closed at any time during operation, a valve positioned in the manifold changes positions upon receipt of an appropriate signal to alternately accept flow from the cylinders in a timed fashion (i.e., flow is only accepted from one cylinder at a time).

The feed piston positioned within each feed cylinder reciprocates through an intake stroke, where it assists in obtaining a full charge in the cylinder by drawing product therein (the valve in the manifold housing having closed off communication with this cylinder), and a discharge stroke where the piston advances through the cylinder to discharge product through the discharge outlet and into the common manifold (the valve in the manifold having opened to accept flow therefrom). Preferably, the feed pistons are wedged-shaped such that they taper downwardly toward the discharge outlet within the respective cylinder when the feed piston is at or near top dead center ("TDC"). Consequently, product tends to gravitate down this inclined surface of the feed piston toward the discharge outlet, thereby reducing the potential for product becoming trapped in the feed cylinders.

The timing for reciprocation of the feed pistons in their respective cylinders is important to providing a substantially uniform discharge pressure. In this regard, the discharge strokes of the pistons overlap to a degree. More particularly, the present invention utilizes a precompression stroke wherein one feed piston moves away from bottom dead center ("BDC") to compress the product within the respective feed cylinder as the second feed piston undergoes its discharge stroke. Precompression occurs since the valve positioned in the common manifold only accepts flow from one discharge outlet and feed cylinder at a time. Consequently, air pockets and the like in the product are removed (i.e., forced out of the cylinder through various sealing points) until a predetermined pressure related to the pressure within the feed cylinder is detected by a pressure sensor or transducer, which signals the end of the precompression stroke. After reaching this pressure, the drive assembly for the first feed piston is turned or switched off until it receives a signal that the second feed piston has nearly completed its discharge stroke, such that the discharge stroke of the first feed piston may then be initiated. However, no product is actually discharged from the cylinder having the first feed piston until the second feed piston reaches TDC, at which time the valve in the manifold is repositioned to accept flow from the cylinder having the first feed piston. By basing a precompression stroke of an adjustable, predetermined pressure versus, for instance, a timed delay, a more uniform product pressure prior to discharge may be obtained, which coincides with a more uniform product discharge pressure.

Preferably, the present invention also includes a number of additional features to further assist in attaining a more uniform product discharge pressure. For instance, a vacuum housing device is positioned between the hopper and the feed cylinders to remove air from the product as it flows into the selected feed cylinder, which desirably affects the uniformity of the charge initially supplied to the feed cylinders by creating a more uniform product density. Moreover, an auger positioned within the hopper is driven by a suitable drive assembly to mix the product near the inlet to the feed cylinders to reduce the likelihood of product becoming jammed in this area, the result of such jamming being that the amount of product supplied to the selected feed cylinder could be adversely affected.

In operation of the present invention, a given product such as sausage material is placed within the hopper. Upon initiation of the drive assembly, the shutter plate for the first feed cylinder, for instance, opens to allow product to begin flowing therein. At this point, the first feed piston has completed its discharge stroke and has slightly retracted to reduce the pressure within the first feed cylinder to allow the shutter plate to be more easily opened. At this time, the second feed piston is on its discharge stroke and product is being discharged from the second feed cylinder. As the first feed piston retracts within the cylinder after the shutter plate is opened, product flows by gravity into the cylinder and is also drawn into the cylinder by the suction-type action of the retracting first feed piston since the valve in the common manifold has closed communication with the first feed cylinder. The vacuum device also removes air from the product as it enters the cylinder to supply a product of more uniform density thereto. After the first feed piston reaches the end of its intake stroke at BDC, the shutter plate for the first feed cylinder is closed to isolate the cylinder from the hopper. The first feed piston thereafter begins its precompression stroke, during which a pressure sensor monitors a pressure related to that within the first feed cylinder generated by the compression of the product therein. Precompressing continues until a certain predetermined pressure is achieved, after which a signal is sent to the drive assembly to stop further advancement of the first feed piston. The first feed piston thereafter initiates its discharge stroke when a signal is received by the drive assembly that the second feed piston has neared completion of its discharge stroke. However, no product is discharged from the first feed cylinder at this point since the valve in the manifold does not allow communication therewith until the second feed piston actually completes its discharge stroke. After the second feed piston reaches TDC, the valve is repositioned to accept product from the first feed cylinder as the first feed piston continues its discharge stroke.

Advantages of the present invention generally relate to achieving a more uniform product discharge pressure that results in providing a product having a substantially uniform density. Consequently, when used with a packaging machine, a constant packaged weight may be obtained.

The present invention includes various features to achieve the desired results. For instance, the vacuum device is positioned between the hopper and the feed cylinders to move air from the product as it enters the selected feed cylinder to provide a more air-free initial charge of product prior to any precompression. Moreover, a precomposition stroke, the length of which depends upon a pressure related to that within the feed cylinder, is used to provide a more consistent charge prior to initiation of the discharge stroke by further reducing the amount of air contained within the product. Furthermore, a unique feed piston configuration reduces the likelihood of product becoming trapped in the cylinder by tapering the face of the piston such that product flows down the face of the piston to the respective discharge outlet. Relatedly, the discharge outlets are slot-shaped so as to extend around a portion of the perimeter of the associated feed piston so as to obtain a larger flow of product therein, and such discharge outlets also taper inwardly toward the manifold to further enhance pressure uniformity at discharge.

Additional advantages of the present invention will become apparent from the following discussion, particularly when taken together with the accompanying drawings.

DETAILED DESCRIPTION

Figure 1:
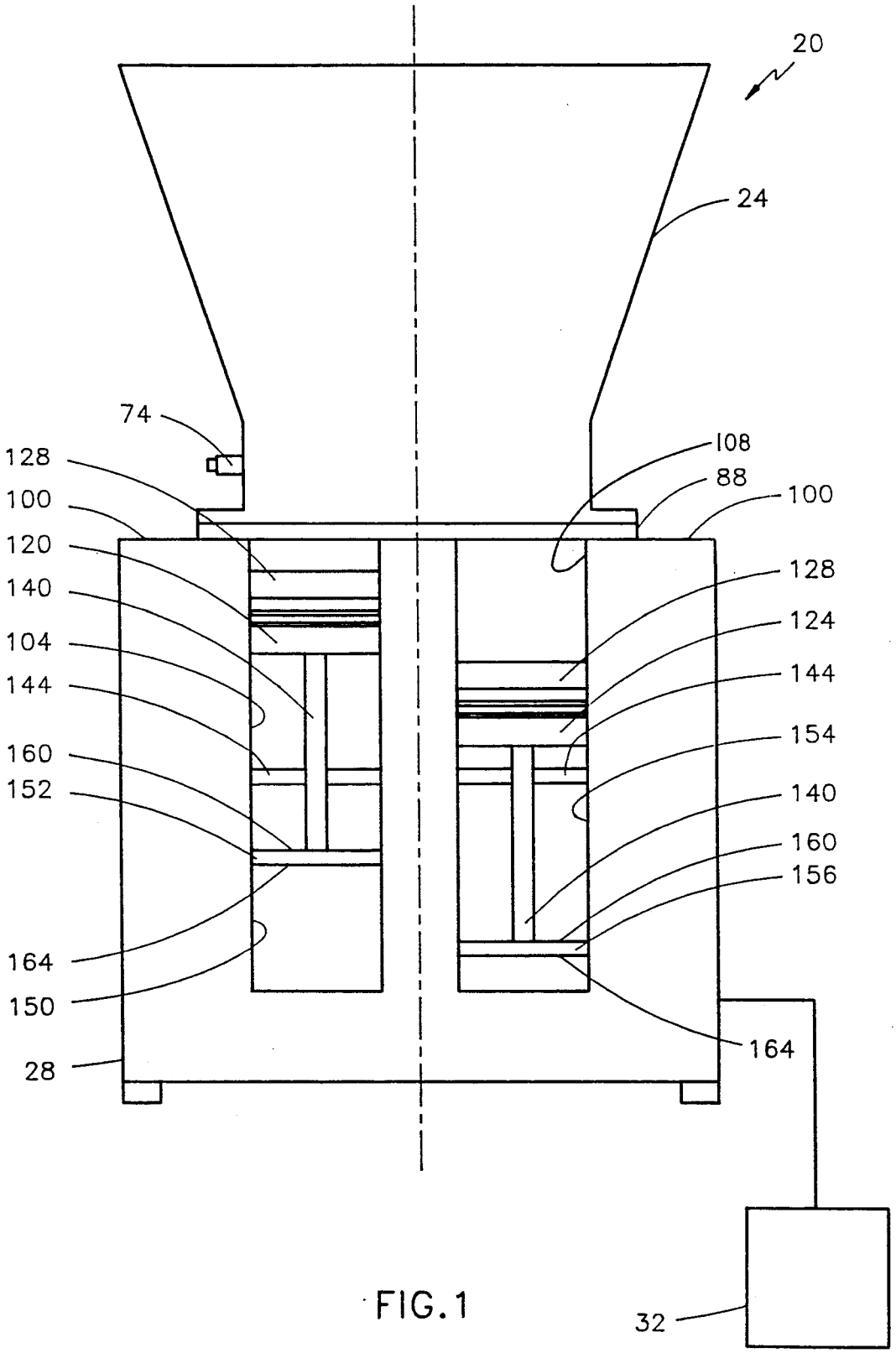
FIG. 1 is a front view of the present invention with portions of the cylinder housing broken away to illustrate the feed pistons and cylinders and the hydraulic pistons and cylinders.

The present invention will be described with reference to the accompanying drawings which illustrate the various features of the present invention contributing to the provision of a product having a substantially uniform pressure at discharge. Referring to FIG. 1, the pumping apparatus 20 of the present invention generally includes three primary components, namely a hopper 24, cylinder housing 28, and drive assembly 32. Any number of types of food-related products such as ground beef, etc., may be positioned in the hopper 24 and pumped by the generally alternately reciprocating movement of the first and second feed pistons 120, 124 to an appropriate downstream processing or packaging machine.

Figure 2:
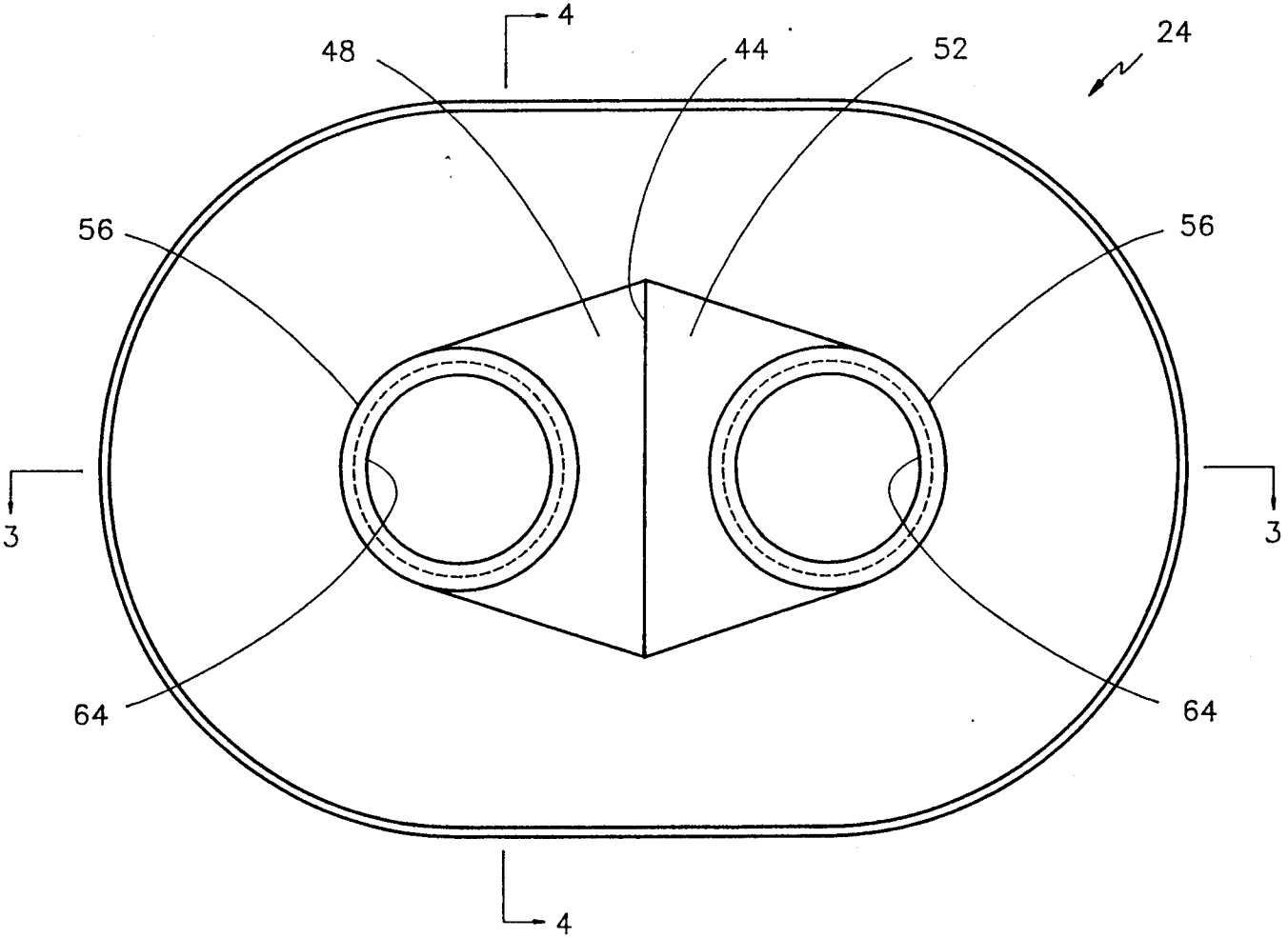
FIG. 2 is a top view of the hopper.
Figure 3:
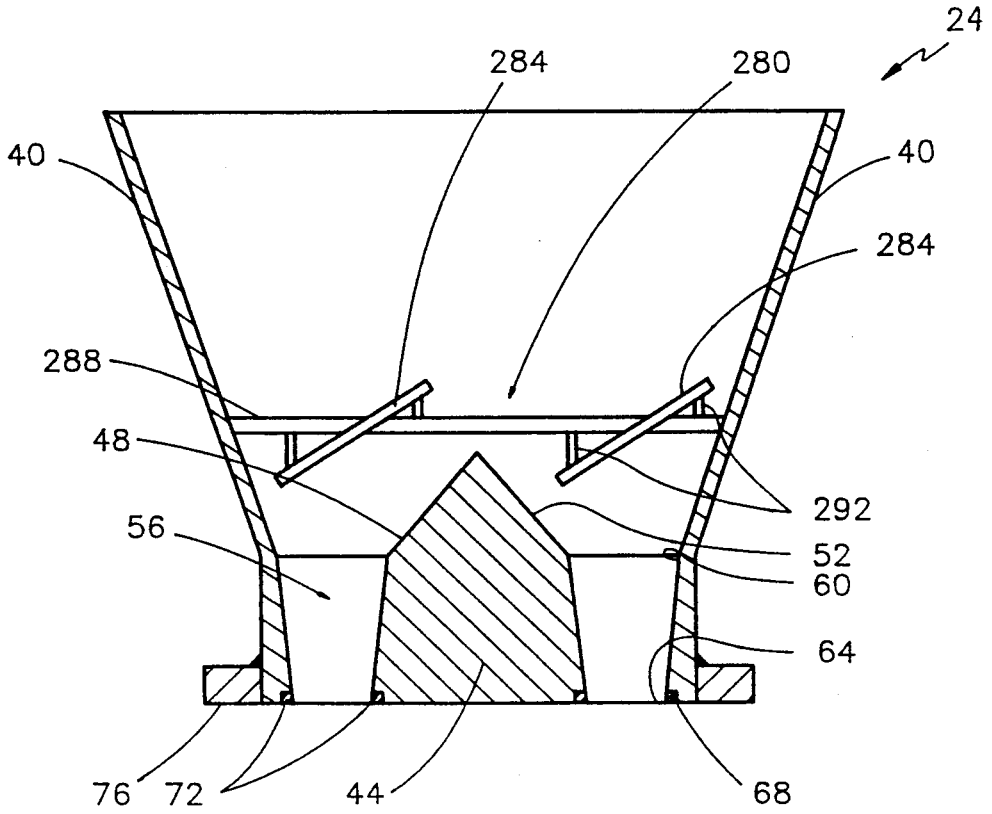
FIG. 3 is a cross-sectional view of the hopper of FIG. 2 taken along line 3—3.
Figure 4:
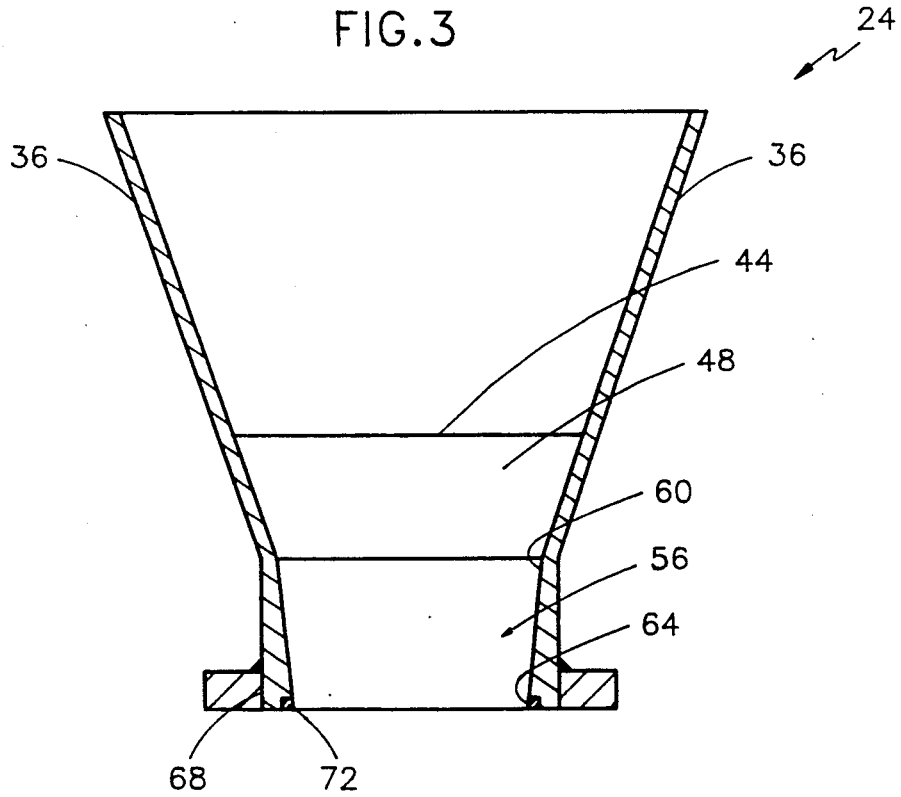
FIG. 4 is a cross-sectional view of the hopper of FIG. 2 taken along line 4—4.

As illustrated in FIGS. 2-4, the hopper 24 includes two side walls 36 and two end walls 40, all of which are integrally connected to define a substantially continuous inner surface which reduces the potential for product becoming trapped therein. Preferably, both side walls 36 and/or both end walls 40 taper inwardly from the upper portion of the hopper 24 to its lower portion, as best illustrated in FIGS. 3 and 4, such that product will easily slide down through the hopper 24 and into the hopper outlets 56 for passage into the cylinder housing 28.

The lower portion of the hopper 24 contains a divider 44 which separates the individual hopper outlets 56. The divider 44 is a triangular structure having a first divider surface 48 and a second divider surface 52, both of which taper from the top of divider 44 down toward the associated hopper outlet 56 to direct flow of product thereto. The hopper outlets 56 are aligned with the first and second feed cylinders 104, 108 positioned within the cylinder housing 28 and taper inwardly from their respective upper ports 60 to their lower ports 64 such that the lower ports 64 are preferably the same size as the first and second feed cylinders 104, 108. An auger 280 is preferably positioned above the hopper outlets 56, as best illustrated in FIG. 3, and is rotatably driven by an appropriate drive mechanism (not shown) to mix and break up the product so that product continues to flow into the hopper outlers 56 during operation. As illustrated in FIG. 3, the auger 280 preferaby includes two substantially circular hoops 284, one being positioned over each hopper outlet 56, which are attached to the auger shaft 288 by hoop connectors 292.

As will be discussed in more detail below, the incorporation of a precompression stroke in a preferred embodiment results in the reduction of air pockets within the product to attain a more uniform product pressure and density prior to discharge, which thus improves the uniformity of the discharge pressure as well. In order to enhance the uniformity of product density initially supplied to the first and second feed cylinders 104, 108, a vacuum ring 72, illustrated in FIGS. 3 and 4, is positioned between each hopper outlet 56 and the associated first and second feed cylinder 104, 108. The function of each vacuum ring 72 is to remove air from the product prior to entering the first and second feed cylinders 104, 108. In this regard, a vacuum pump (not shown) attaches to the vacuum connector 74 on the hopper 24 (FIG. 1), which interacts with the vacuum rings 72 to apply the necessary suction to the vacuum rings 72. The vacuum rings 72 are preferably positioned in vacuum ring slots 68 in proximity to each lower port 64 of the hopper outlets 56. The vacuum rings 72, however, could be positioned in a number of alternate locations to perform the same desired function.

The hopper 24 has a hopper mounting plate 76 positioned on the lower portion thereof which is used to attach the hopper 24 to the shutter plate holder 88 of the cylinder housing 28. Although any number of suitable methods may be used to establish this connection, preferably a pivotal connection (not shown) is used such that the hopper 24 may be pivoted away from the shutter plate holder 88 and the cylinder housing 28 to provide access to the first and second feed cylinders 104, 108 to allow for the cleaning thereof. The only real limitation for establishing the connection between the hopper 24 and the shutter plate holder 88 of the cylinder housing 28 is that the alignment of the hopper outlets 56 and the first and second feed cylinders 104, 108 must be substantially maintained during operation of the pumping apparatus 20.

Figure 5:
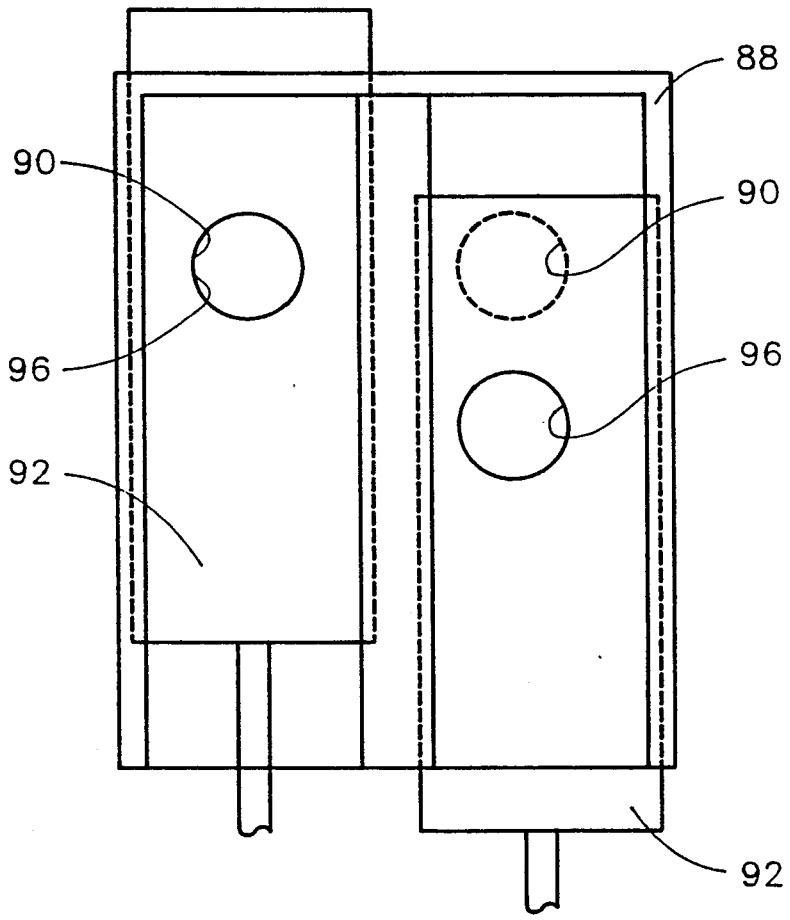
FIG. 5 is a top view of the shutter plate assembly.

The shutter plate holder 88 is appropriately positioned between the hopper 24 and the cylinder housing 28 as best illustrated in FIG. 1, the lower portion of which has a pair of shutter plate holder outlets 90 in alignment with the respective hopper outlets 56 and the first and second feed cylinders 104, 108 as best illustrated in FIG. 5. Preferably, the shutter plate holder outlets 90 are the same size as the lower ports 64 of the hopper outlets 52 and as the first and second feed cylinders 104, 108. Although any number of methods of attachment may be used, preferably the shutter plate holder 88 is pivotally connected (not shown) to the cylinder housing 28 such that access may be obtained to the first and second feed cylinders 104, 108.

A pair of shutter plates 92 are positioned within parallel receiving areas of the shutter plate holder 88 which reciprocate in a timed relationship with reciprocation of the first and second feed pistons 120, 124 to essentially function as intake valves for the first and second feed cylinders 104, 108. In order to produce the desired timed reciprocation, a system such as that disclosed in U.S. Pat. No. 4,691,411 to Higashimoto, issued Sep. 8, 1987, is preferred since it interacts with that portion of Higashimoto corresponding to the drive assembly 32 of the present invention for reciprocating the first and second feed pistons 120, 124.

In order to allow flow of product into the first and second feed cylinders lug, 108, each shutter plate 92 has a shutter plate outlet 96 which is preferably the same size as the lower ports 64 of the hopper outlets 56, the shutter plate holder outlets 90, and the first and second feed cylinders 104, 108. The primary advantage of this uniform passageway from the hopper 24 to the first and second feed cylinders 104, 108 is the reduction of potential for product becoming trapped therein. Consequently, the reciprocation of the shutter plates 92 moves the shutter plate outlets 96 into and out of alignment with, ultimately, the hopper outlets 56 and the first and second feed cylinders 104, 108 to allow flow of product into and out of the first and second feed cylinders 104, 108 at the appropriate time.

Since the shutter plates 92 move through product flowing down through the hopper outlets 56 during operation, it is desirable to construct the shutter plates 92 from materials which nave a low surface friction and a high strength, such as a high density polyethylene. A preferred material for forming the shutter plates 92, however, is a virgin, ultra-high molecular weight polyethylene.

Figure 6:
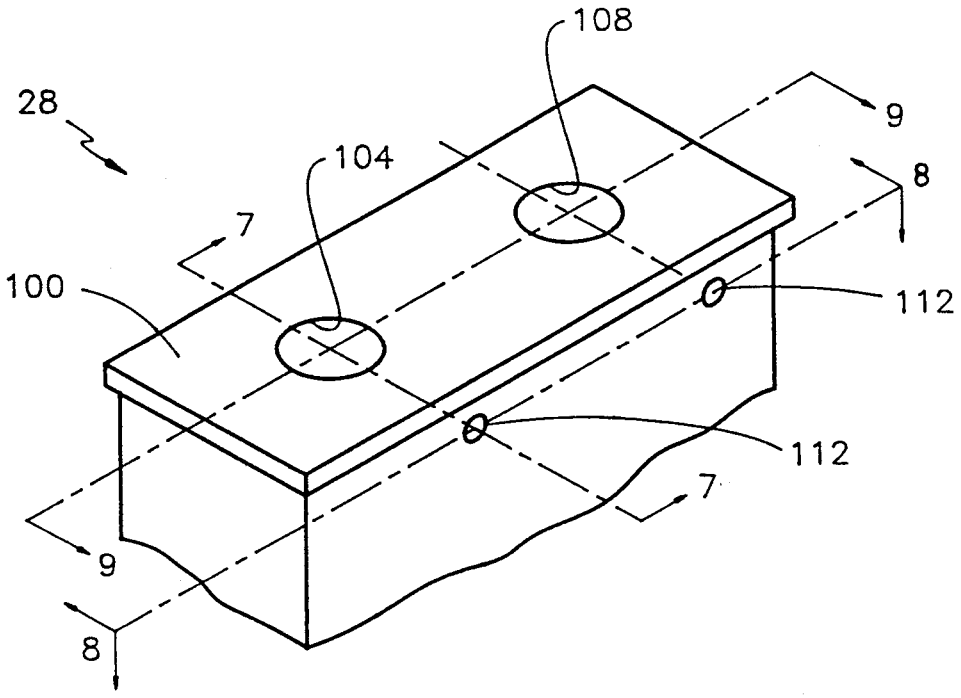
FIG. 6 is a perspective view of the upper portion of the cylinder housing.
Figure 7:
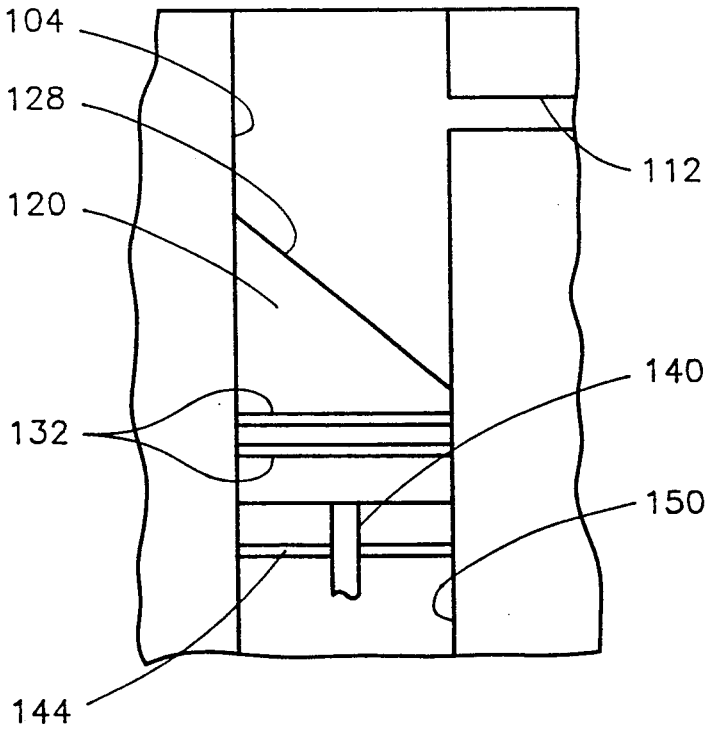
FIG. 7 is a cutaway view of a portion of the feed cylinder taken along line 7—7 of the cylinder housing of FIG. 6, illustrating the positioning of the wedged-shaped piston therein.
Figure 8:
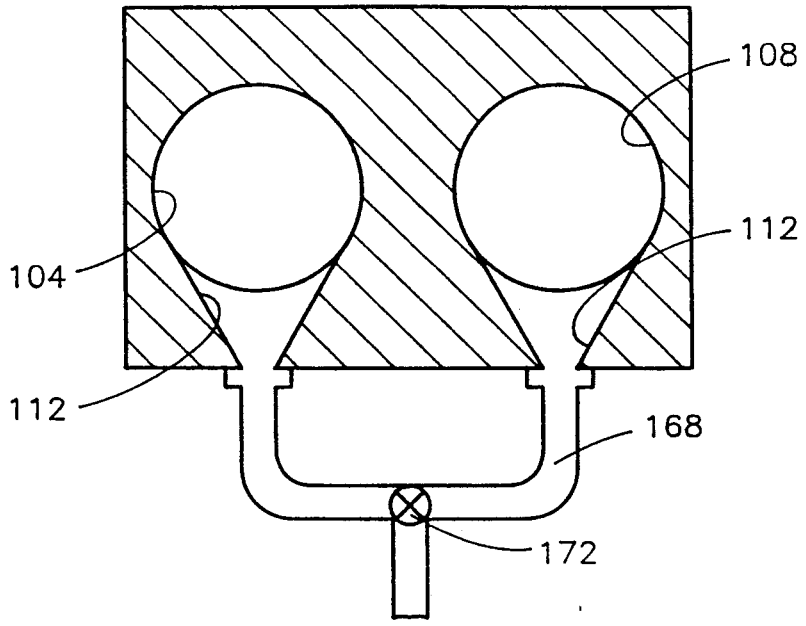
FIG. 8 is a cross-sectional view of the cylinder housing of FIG. 6 taken along line 8—8.

The cylinder housing 28 contains those portions of the pumping apparatus 20 used to actually discharge the product. As illustrated in FIGS. 1, 6, and 8, the cylinder housing 28 contains the first and second feed cylinders 104, 108 which are positioned in substantial alignment with the associated hopper outlets 56 and shutter plate holder outlets 90 as described above. The first feed cylinder 104 has a reciprocable first feed piston 120 contained therewithin and second feed cylinder 108 similarly has a second feed piston 124. The first and second feed pistons 120, 124 reciprocate in a timed relationship (discussed below) to alternately allow product to enter the respective first or second feed cylinders 104, 108 by proper alignment of the shutter plate outlet 96 of the shutter plate 92 associated therewith, and to alternately discharge product from the first and second feed cylinders 104, 108, after closing of the associated shutter plate 92 such that the shutter plate outlet 96 is not aligned with the shutter plate holder outlet 90, through a feed outlet 112 positioned on each of the first and second feed cylinders 104, 108.

Figure 9:
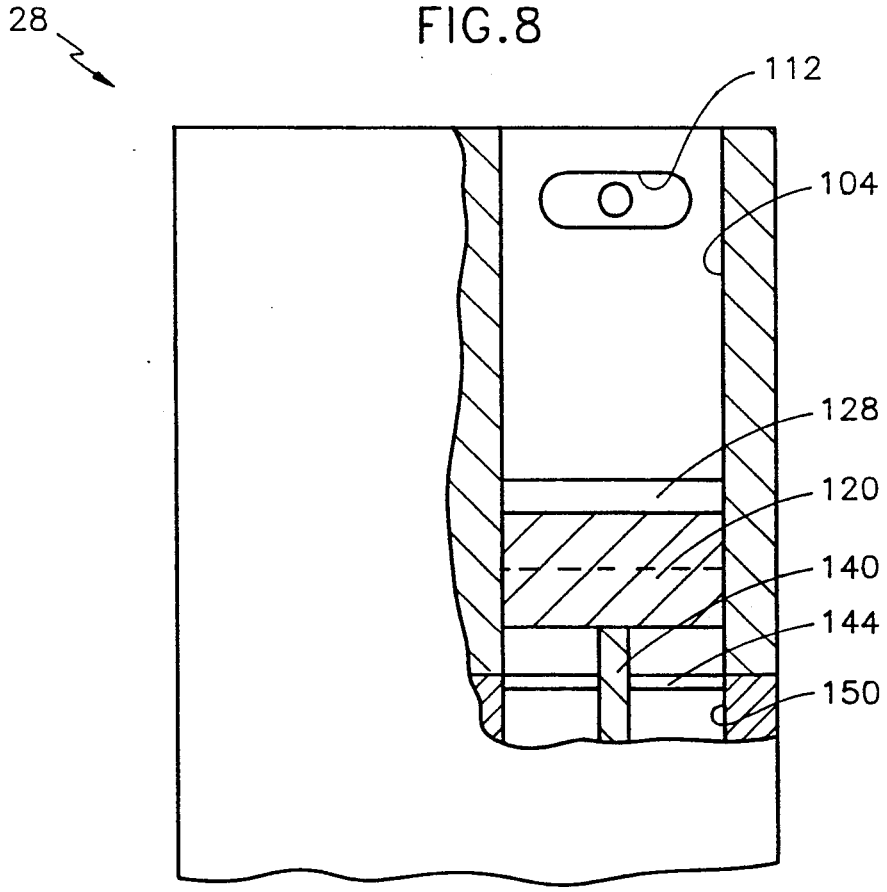
FIG. 9 is a partial cross-sectional view of the cylinder housing of FIG. 6 taken along line 9—9.
Figure 10:
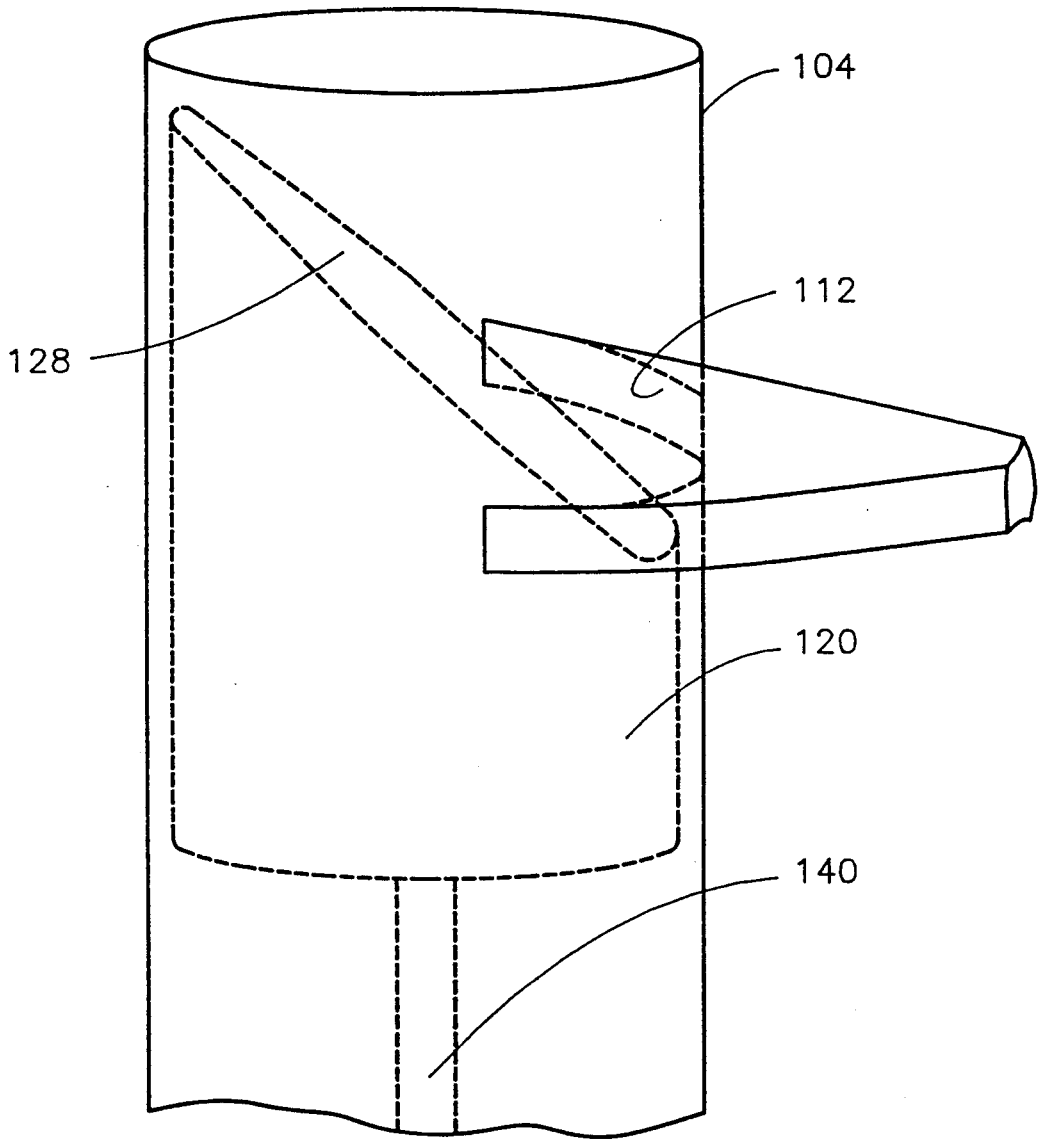
FIG. 10 is a perspective view of a feed cylinder and the interrelationship between the preferred wedged-shaped feed piston and funnel-shaped discharge outlet.

As best illustrated in FIGS. 8–10, each feed outlet 112 is preferably slot-shaped so as to follow a portion of the perimeter of the respective first or second feed piston 120, 124 which allows more product to be supplied thereto. Moreover, the feed outlets 112 also preferably taper inwardly toward the position where the feed outlets 112 connect to the manifold 168. This tapering of the feed outlets 112 further assists in providing a more uniform product discharge pressure. Although the feed outlets 112 remain open throughout operation of the pumping apparatus 20, a valve 172 positioned within the manifold 168 only allows flow of product from first and second feed cylinders 104, 108 in essentially a timed, alternate fashion. Consequently, the feed outlets 112 are in essence closed during a portion of the cycle of the reciprocation of the first and second feed pistons 120, 124, particularly during their intake and precompression strokes as is discussed in more detail below.

Figure 11:
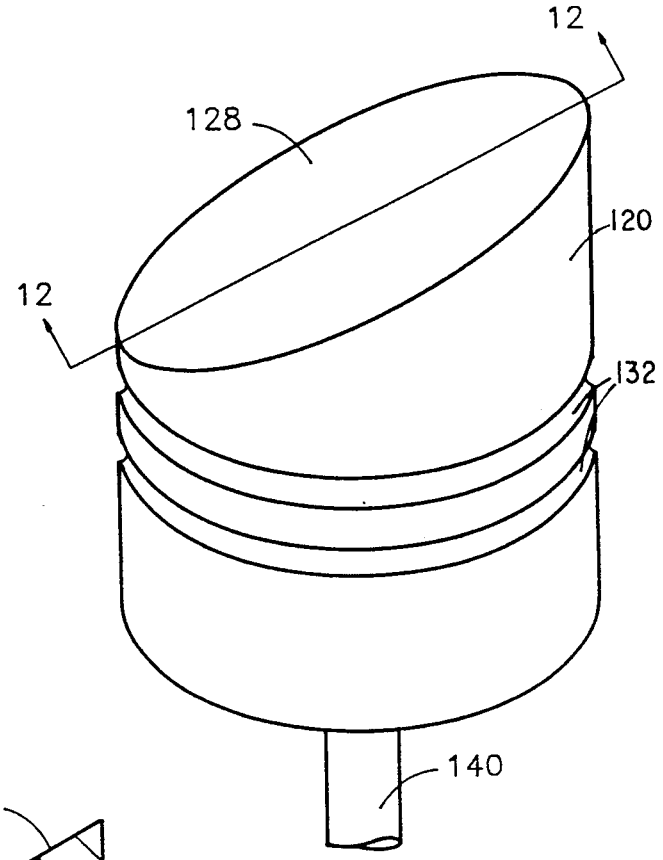
FIG. 11 is a perspective view of a preferred feed piston configuration.
Figure 12:
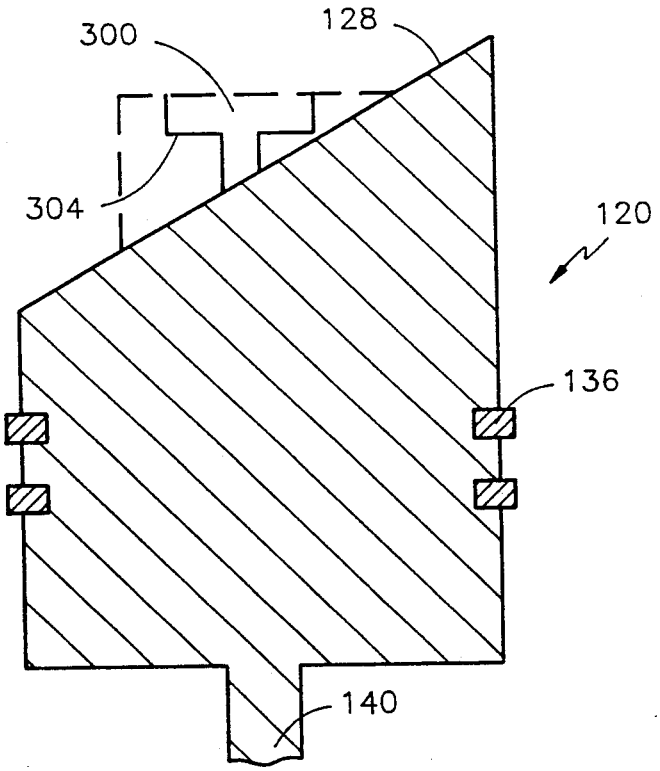
FIG. 12 is a cross-sectional view of the piston of FIG. 11 taken along line 12—12.

The first and second feed cylinders 104, 108 contain reciprocable first and second feed pistons 120, 124, respectively. The structural configuration of the first and second feed pistons 120 and 124 are similar and therefore only discussion of one will follow. Referring particularly to FIGS. 10–12, the first feed piston 120 is preferably wedged-shaped such that it tapers downwardly over at least a portion of the piston face 128. As best illustrated in FIG. 10, this downward tapering of the piston face 128 directs product toward the feed outlet 112 of the first feed cylinder 104 as the first feed piston 120 nears TDC. Since the downward taper of the piston face 128 initiates from the point in the first feed cylinder 104 farthest from the associated feed outlet 112, the wedge-shaped design reduces the potential for product becoming trapped in the first feed cylinder 104, stagnating for a time, and possibly later being discharged. Moreover, in order to reduce the potential for product passing between the first feed piston 120 and the first feed cylinder 104, first feed piston 120 also incorporates two O-ring slots 132 which contain O-rings 136 to establish a sufficient seal between first feed piston 120 and first feed cylinder 104.

Although numerous materials are suitable for the manufacture of the first and second feed pistons 120, 124, those which have low surface friction and high strength characteristics are must desirable so that in the preferred configuration, product will easily flow down the piston face 128. The preferred material, however, is a high density polyethylene or, if available in the quantities required for the first and second feed pistons 120, 124, a virgin ultra-high molecular weight polyethylene.

Figure 13:
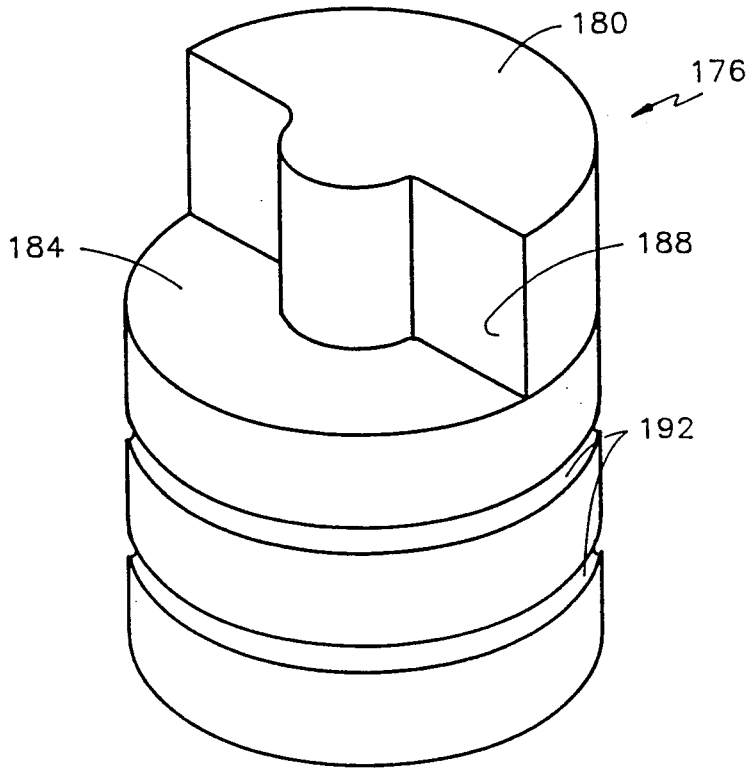
FIG. 13 (PRIOR ART)
FIG. 13 is a perspective view of one known feed piston configuration.

Various configurations of feed pistons have been previously used in pumping apparatuses of the type generally disclosed herein, namely food pumps. A cutout feed piston 176 having a crown 180 and a cutout 184, as well as O-ring slots 192 for retaining an o-ring for establishing a seal with a cylinder wall, is illustrated in FIG. 13. The cutout 184, which is substantially horizontal, is in part defined by a substantially vertical cutout fall 188 which essentially bisects the cutout feed piston 176. In this type of configuration, it would appear that there would exist a high potential for product becoming trapped on both the cutout 184 and the upper portion of the crown 180 during the reciprocating motion, particularly at TDC.

Figure 14:
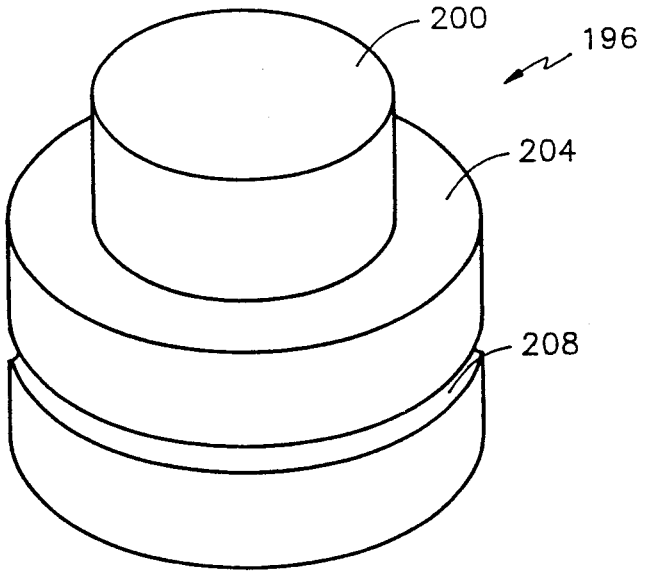
FIG. 14 (PRIOR ART)
FIG. 14 is a perspective view of a second known feed piston configuration.

A second configuration of a known feed piston is illustrated in FIG. 14. Crown feed piston 196 has an upper crown 200 entirelY surrounded by a stepped surface 04. In addition, an O-ring slot 208 is provided for retaining an O-ring to sealingly engage the piston and its cylinder. This configuration, however, would also appear to produce a strong potential for product becoming trapped on the top of crown 200 and/or the stepped surface 204 during the reciprocating motion of the crown feed piston 196, particularly that portion of the stepped surface 204 positioned on the back side of crown 200 in relation to an outlet port of the type suggested herein.

The first and second feed pistons 120, 124 are reciprocatingly driven by an appropriate drive assembly 32 in a particular timed relationship. Although the drive assembly 32 is illustrated in FIG. 1 as being separate from the cylinder housing 28, the two may of course be combined into a single unit. Preferably, the drive assembly 32 is a hydraulic system including a first hydraulic cylinder 150 and piston 152 associated with first feed cylinder 104 and piston 120, and a second hydraulic cylinder 154 and piston 156 associated with the second feed cylinder 108 and piston 124. As will become apparent in the discussion which follows, a similarly structured pneumatic system may also be appropriate.

Figure 15:
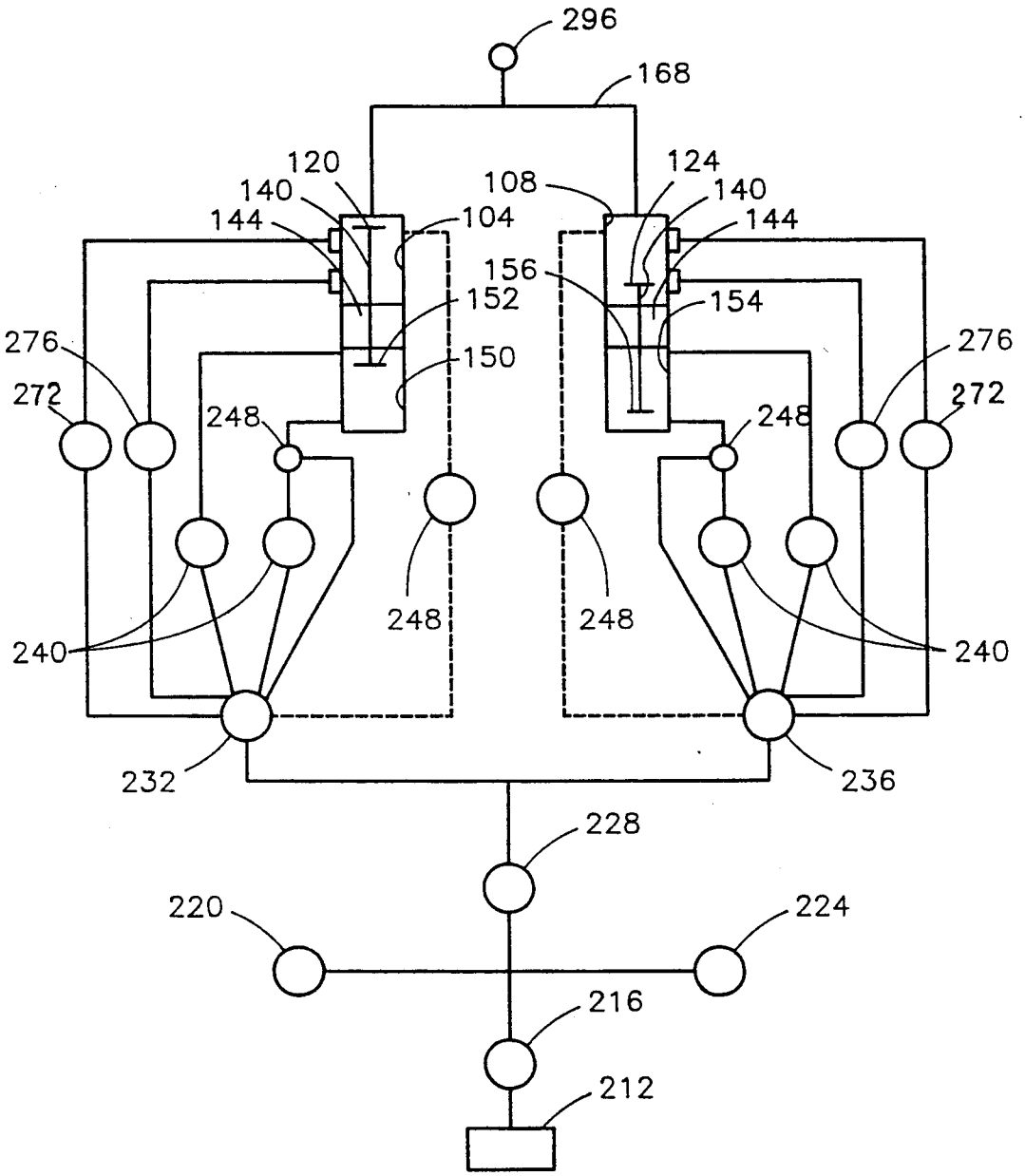
FIG. 15 is a schematic of the preferred hydraulic drive system for the present invention.

Due to the structural and operational similarities, further discussion of the drive assembly 32 will primarily reference that portion associated with a single feed piston, namely first feed piston 120. The first hydraulic cylinder 150 is positioned substantially directly below the first feed cylinder 104 and is separated therefrom by a cylinder divider 144. The piston shaft 140, connected to the first feed piston 120, extends through the cylinder divider 144 and attaches to the first hydraulic piston 152 which is reciprocally positioned within the first hydraulic cylinder 150 as best illustrated in FIGS. 1 and 15. Although numerous methods of attaching the piston shaft 140 to the first feed piston 120 may be utilized, it may be necessary to modify the piston face 128 in the manner indicated by the dashed lines in FIG. 12 (i.e., positioning a small block on the central region of the piston face 128) so that a fastener 300 may seat against a substantially flat surface 304 to engage the piston shaft 140, which in this configuration would extend up into the body of the first feed piston 120. The first hydraulic piston 152, also appropriately connected to the piston shaft 140, has an upper piston face 160 and a lower piston face 164. Consequently, reciprocation of the first feed piston 120 is generally achieved by providing a flow of hydraulic fluid to the upper or lower piston face 160, 164 of the first hydraulic piston 152 by a system and in a manner to be described in more detail below.

The preferred drive assembly 32 for the pumping apparatus 20 is substantially similar to that disclosed in U.S. Pat. No. 4.691,411 to Hiqashimoto, issued Sep. 8, 1987, which is hereby incorporated by reference herein, except primarily for the addition of the pressure sensors 248 (discussed below) which determine the length of the precompression stroke for the first and second feed pistons 120, 124, as opposed to the timer utilized by Higashimoto. Each of the pressure sensors 248 is a commercially available unit that is able to compare two inputs. Depending upon the magnitudes of the two inputs, one of two states or outputs are generated by the pressure sensors 248. The first input relates to an actual pressure being sensed (within the feed or hydraulic cylinders as discussed below) that can vary during normal pumping operations. This input relates to the pressure in the particular cylinder at any instance in time. A second input is a predetermined or preset input that relates to a desired or suitable pressure. The second input is entered or controlled by the user or operator of the pumping apparatus 20. The two inputs are continuously compared by each pressure sensor 248. When the first input or actual pressure sensed becomes equal to or greater than the preset pressure, the output of the pressure sensor 248 charges and an electrical signal is outputted indicative of the condition that the desired pressure has been reached or exceeded. This electrical signal indicating such a state can be used to control or stop the application or further hydraulic fluid to the appropriate hydraulic piston and cylinder. As can be readily understood, because the operator of the pumping apparatus 20 is able to control the magnitude of the second input, adjustment can be made to achieve a desired, uniform pressure in the reed cylinders. Consequently, the possibility of non-uniform or inconsistent product deliveries is reduced because of the presence of a desired pressure that results in product, having the desired density, being discharged.

Generally regarding the configuration of the hydraulic system utilized, a hydraulic pump 216 receives hydraulic fluid from a hydraulic source 212. The hydraulic pump 216 directs hydraulic fluid to the first and second solenoids 232, 236 which directly control the reciprocation of the first and second feed pistons 120, 124, respectively, by primarily applying hydraulic fluid to the appropriate surface of the first and second hydraulic pistons 152, 156, respectively. Flow regulators 240 may be positioned between the first solenoid 232 and the first hydraulic piston 152 and between the second solenoid 236 and the second hydraulic piston 156. Moreover, various devices such as a pressure indicator 224, pressure relief valve 220, and check valve 228, which enhance the operational safety of the drive assembly 32, may be positioned between the hydraulic pump 216 and the first and second solenoids 232, 236.

Figure 16:
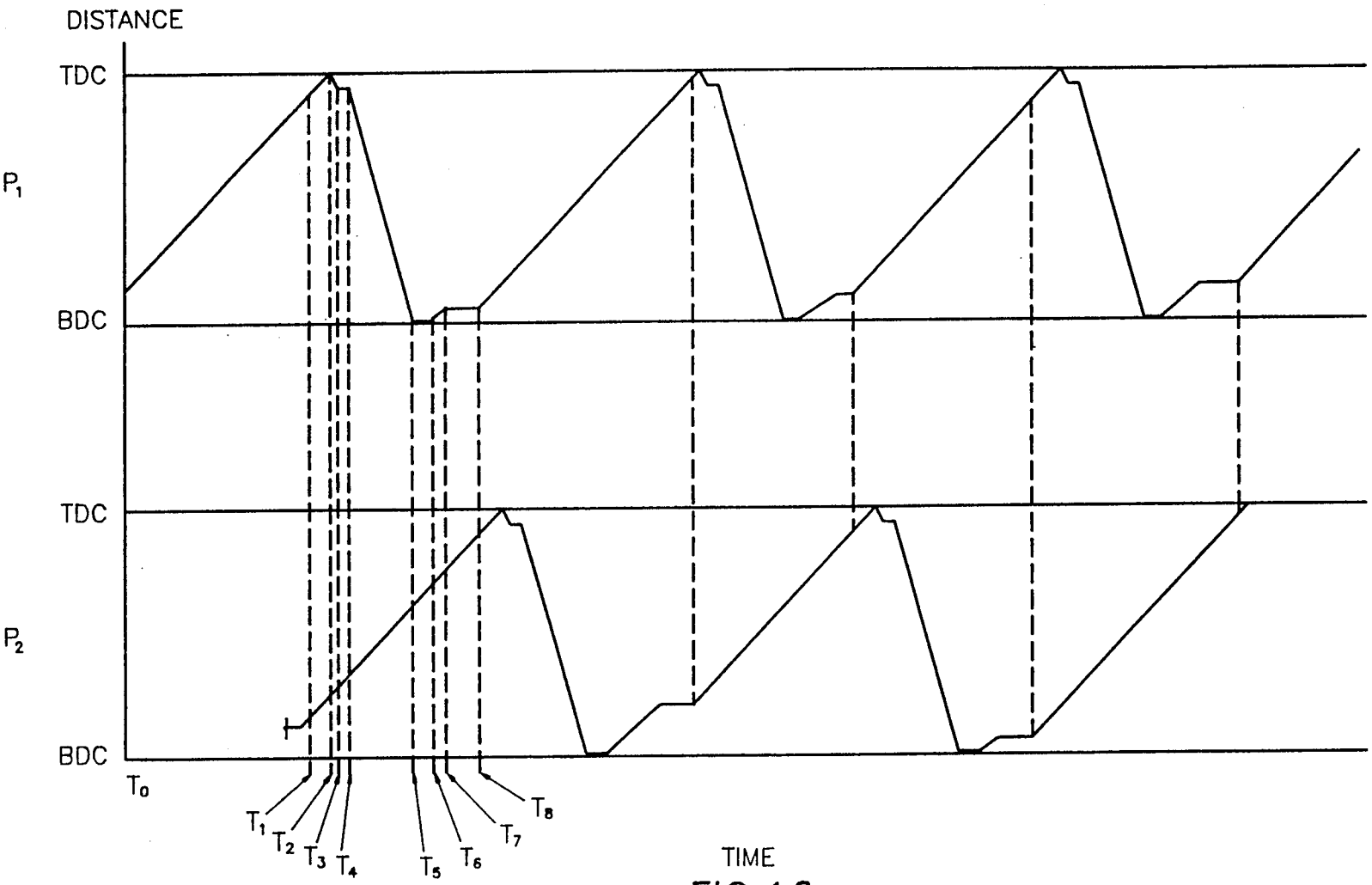
FIG. 16 illustrated exemplary timing curves of the reciprocation of the feed pistons, specifically indicating the possible varying lengths of the precompression strokes to obtain the desired precompression pressure.

Although the drive assembly 32 has only been generally described, the description of the reciprocation of the first and second reed pistons 120, 124 in a manner illustrated by the timing curves of FIG. 16 better emphasizes its operational significance. With reference to FIG. 16, at time $T_0$ the first feed piston 120 undertakes its discharge stroke as a result of the first solenoid 232 directing flow of hydraulic fluid to the lower piston face 164 or the first hydraulic piston 152. At time $T_1$, an upper limit detector 272 positioned on or near the first feed cylinder 104 senses that the first feed piston 120 is nearing the end of its discharge stroke. This upper limit detector 272 sends a signal to the second solenoid 236, resulting in the application of hydraulic fluid to the lower piston face 160 of the second hydraulic piston 156 to initiate the discharge stroke of the second feed piston 124. However, no product is actually discharged from the second feed cylinder 108 since the valve 172 within the manifold 168 is still positioned to only accept flow from the first feed cylinder 104.

After a predetermined time delay at time $T_2$, a signal is sent to the first solenoid 232 to initiate the downward stroke of the first feed piston 120 by directing the flow of hydraulic fluid to the upper piston face 160 of the first hydraulic piston 152. Moreover, the valve 172 within the manifold 168 is now repositioned upon receipt of an appropriate signal to accept flow from the second feed cylinder 108 and the second feed piston 124 continues its discharge stroke. After another predetermined time delay at $T_3$, the first solenoid 232 discontinues the flow of hydraulic fluid to the first hydraulic piston 152. This initial retraction of the first feed piston 120 removes pressure from the shutter plate 92 associated with the first feed cylinder 104 such that it may be more easily opened. After the lapse of another predetermined rime delay at $T_4$ to allow the associated shutter plane 92 to fully open, the first solenoid 232 reinitiated the flow of hydraulic fluid to the upper piston face 160 of the first hydraulic piston 152 so that the first feed piston 120 retracts, resulting in product flowing from the hopper 24 into the first feed cylinder 104 as described above. Vacuum ring 72 also removes air from the product at this time.

At time $T_5$, the first feed piston 120 reaches BDC as sensed by a lower limit detector 276 positioned on the lower portion of the first feed cylinder 104, at which time the lower limit detector 276 sends a signal to the first solenoid 232 to discontinue the flow of hydraulic fluid to the upper piston face 160 of the first hydraulic piston 152. A second lOWer limit detector 276, being positioned on the lower portion of the second feed cylinder 108, performs the same function for the second feed piston 124 by interacting with the second solenoid 236. After the lapse of a predetermined time delay at time $T_6$, during which time a signal is sent to the shutter plate 92 for the first feed cylinder 104 to close the shutter plate 92 to move the shutter plate outlet 96 out of alignment with the hopper. outlet 56 associated therewith, the first solenoid 232 directs hydraulic fluid to the lower piston face 164 of the first hydraulic piston 152 to initiate the precompression stroke for the first feed piston 120.

The precompression stroke of the first feed piston 120 continues until a predetermined pressure is achieved or exceeded in the hydraulic line directed to the lower piston face 164 of the first hydraulic piston 152, as sensed by a first pressure sensor 248 positioned thereon. This pressure is, of course, directly related to the pressure within the first feed cylinder 104. Consequently, the first pressure sensor 248 could alternately be positioned directly to sense the pressure within the first feed cylinder 104 as indicated by the dashed lines in FIG. 15. Upon sensing the predetermined pressure, a signal from the first pressure sensor 248 is converted to an electrical signal by known methods and is directed to the first solenoid 232 to discontinue the application of additional hydraulic fluid to the lower piston face 164 of the first hydraulic piston 152 which occurs at time $T_7$. At rime $T_8$, at which time the upper limit detector 272 for the second feed piston 124 senses that it is nearing the end of its discharge stroke, a signal is directed to the first solenoid 232 to reinitiate the application of hydraulic fluid to the lower piston face 164 of the first hydraulic piston to initiate the discharge stroke of first feed piston 120. However, no discharge from the first feed cylinder 104 is achieved until the valve 172 is the manifold 168 receives the signal that the second feed piston 124 has reached TDC, at which time the valve 172 will move to accept flow from the first feed cylinder 104. Thereafter, the cycle repeats itself during the remainder of operation of pumping apparatus 20.

As can be appreciated based upon the foregoing description, the time between time $T_6$ and $T_7$, i.e., the time of the precompression stroke, may vary depending upon, in part, the initial uniformity of product pressure within the first and second feed cylinders 104, 108 prior to the precompression stroke, as may the time between time $T_7$ and $T_8$, i.e., the time between the end of the precompression stroke and the beginning of the discharge stroke. This feature is advantageous in that the length of the precompression stroke is not limited to a predetermined time, but instead depends upon the achievement of a predetermined pressure, which enhances the uniformity of product pressure at discharge.

In order for proper precompression to be achieved and maintained, a number of factors must be taken into account. For instance, when a referenced sensor or detector, such as an upper limit detector 272 or a pressure sensor 248, senses the proper condition, there will be a certain inherent time delay before the appropriate reaction is initiated. As an example, between the time one pressure sensor 248 detects the desired precompression pressure within, essentially, the first feed cylinder 104, and the time the first solenoid 232 stops the flow of additional hydraulic fluid to the first hydraulic piston 152, the first hydraulic piston 152, and thus the first feed piston 120, will have traveled a certain distance to further increase the precompression pressure. Consequently, the desired precompression pressure may have to be adjusted during initial operation of the pumping apparatus 20. By incorporating a discharge pressure sensor 296 positioned downstream of the manifold 168 to monitor the discharge pressure, however, the degree of adjustment required to maintain a substantially constant discharge pressure may be easily detected.

Another important factor in achieving and maintaining the desired precompression pressure is the timing of reciprocation between the first and second feed pistons 120, 124. More particularly, the timing must be such that the first feed piston 120 is able to complete its precompression stroke prior to the second feed piston 124 completing its discharge stroke. Although it may be possible to establish a perfect timing such that there will be no delay between the end of the precompression stroke and the beginning of the discharge stroke of the first and second feed pistons 120, 124, it is unlikely that this could be maintained throughout continued operation. Therefore, the reciprocation speeds and timing are such that there will typically be a sufficient delay between the end of the precompression stroke and the beginning of the discharge stroke. For example, for one type of product, the time for the first feed piston 120 to travel from BDC to TDC is approximately 34 seconds, whereas the precompression stroke of the second feed piston 124 only lasts approximately 5 seconds. Consequently, there is sufficient overlap to ensure that a proper precompression will typically be achieved.

The foregoing description of the invention has been presented for purposes of illustration and description. Further, the description is not intended to limit the invention to the form disclosed herein. Consequently, variations and modifications commensurate with the above teachings, in the skill or knowledge of the art, are within the scope of the present invention. The embodiments described hereinabove are further intended to explain best modes known of practicing the invention and to enable others skilled in the art to utilize the invention in such, or other, embodiments and with the various modifications required by their particular applications or uses of the invention. It is intended that the appended claims be construed to include alternative embodiments to the extent permitted by the prior art.

What is claimed is:

1. An apparatus for pumping a product at a substantially uniform discharge pressure, comprising:

hopper means for containing a product;

first and second cylinder means;

inlet means for regulating flow of product from said hopper means to said first and second cylinder means;

outlet means associated with each of said first and second cylinder means for allowing discharge of product from said first and second cylinder means;

manifold means interconnecting said outlet means;

valve means positioned within said manifold means, wherein said valve mean sis movable to alternately allow discharge of product from said first and second cylinder means;

first and second piston means, positioned within each of said first and second cylinder means, respectively, for discharging product from said first and second cylinder means, respectively;

driving means for reciprocating said first and second piston means through at least an intake stroke and discharge stroke, wherein the discharge strokes of said first and second piston means overlap; and pressure sensing means for sensing a pressure related to the pressure within said first cylinder means, wherein said pressure sensing means controls at least a portion of said driving means, said pressure sensing means including:

means for inputting by an operator a variable magnitude relating to a predetermined pressure associated with said first cylinder means; and means for comparing said variable magnitude with a magnitude relating to pressure in only said first cylinder means of said first and second cylinder means during a precompression stroke of said first piston means.

2. An apparatus, as claimed in claim 1, wherein at least a portion of said hopper means tapers inwardly toward said inlet means of said first and second cylinder means.

3. An apparatus, as claimed in claim 1, wherein at least a portion of each of said outlet means of said first and second cylinder means tapers inwardly toward said manifold means.

4. An apparatus, as claimed in claim 1, wherein at least said first piston means has an outer surface for engaging product, said outer surface having a periphery substantially contiguously adjacent to an inner wall portion of said first cylinder means, wherein substantially all straight line portions extending from substantially any point on said periphery inwardly on said outer surface are inclined relative to said inner wall portion that is most adjacent to said point, and wherein a leading portion of said first piston mean within said first cylinder means is positioned along sad periphery.

5. An apparatus, as claimed in claim 1, wherein each of said first and second piston means has a first surface for contacting product, said first surface angling downwardly toward said outlet means during at least a portion of the discharge stroke of each of said first and second piston means.

6. An apparatus, as claimed in claim 1, wherein said driving means includes hydraulic means to drive each of said first and second piston means.

7. An apparatus, as claimed in claim 1, wherein said driving means includes pneumatic means to drive each of said first and second piston means.

8. An apparatus, as claimed in claim 6, wherein said pressure sensing means senses the hydraulic pressure used to drive said first piston means.

9. An apparatus, as claimed in claim 7, wherein said pressure sensing means senses the pneumatic pressure used to drive said first piston means.

10. An apparatus, as claimed in claim 1, wherein said pressure sensing means is positioned within each of said first and second cylinder means to sense the pressure therewithin.

11. An apparatus, as claimed in claim 1, wherein said pressure sensing means controls a portion of said driving means to temporarily discontinue the discharge stroke of said first piston means as said second piston means continues its discharge stroke.

12. An apparatus for pumping a product in a manner which reduces the amount of product which collects in at least a portion of the apparatus, comprising:

hopper means for containing a product;

first and second cylinder means each having inner wall portions;

inlet means for regulating flow of product from said hopper means to said first and second cylinder means;

outlet means, positioned on each of said first and second cylinder means, for receiving a discharge of product from said first and second cylinder means;

first and second piston means, positioned within said first and second cylinder means, respectively, for discharging product from said first and second cylinder means, respectivley, at least said first piston means including an outer surface for engaging the product, said outer surface having a periphery substantially contiguously adjacent to said inner wall portions of said first cylinder means, wherein a first portion of said outer surface of said first piston means within said first cylinder means i positioned along a portion of said periphery at a first distance from a reference plane, said reference plane being perpendicular to a central axis of first cylinder means, and wherein all remaining portions of said outer surface are positioned at a distance from said reference plane which is less than said first distance;

driving means for reciprocating each of said first and second piston means through at least an intake stroke and a discharge stroke.

13. An apparatus, as claimed in claim 12, wherein at least a portion of said hopper means tapers inwardly toward said inlet means to said first and second cylinder means.

14. An apparatus, as claimed in claim 12, wherein at least a portion of each of said outlet means for said first and second cylinder means tapers inwardly toward a manifold means interconnecting said outlet means.

15. An apparatus, as claimed in claim 12, wherein said outer surface angles downwardly toward said outlet means during at least a portion of the discharge stroke of said first piston means.

16. An apparatus, as claimed in claim 12, further including pressure sensing means for sensing a pressure related to the pressure within said first cylinder means, wherein said pressure sensing means controls at least a portion of said driving means, said pressure sensing means including:

means for inputting by an operator a variable magnitude relating to a predetermined pressure associated with said first cylinder means; and means for comparing said variable magnitude with a magnitude relating to pressure in only said first cylinder means of said first and second cylinder means during a precompression stroke of said first piston means.

17. An apparatus, as claimed in claim 16, wherein the discharge strokes of said first and second piston means overlap, and wherein said pressure sensing means disengages a portion of said driving means to temporarily discontinue the discharge stroke of said first piston means as said second piston means continues its discharge stroke.

18. An apparatus, as claimed in claim 17, wherein said driving means includes a hydraulic means to drive each of said first and second piston means.

19. An apparatus, as claimed in claim 17, wherein said driving means includes pneumatic means used to drive each of said first and second piston means.

20. An apparatus, as claimed in claim 18, wherein said pressure sensing means senses the hydraulic pressure used to drive said first piston means.

21. An apparatus, as claimed in claim 19, wherein said pressure sensing means senses the pneumatic pressure used to drive said first piston means.

22. An apparatus, as claimed in claim 17, wherein said pressure sensing means is positioned on said first and second cylinder means to directly sense the pressure within said first and second cylinder means.

23. A method for discharging a product at a substantially uniform pressure by using an alternating, reciprocating pumping apparatus having at least first and second feed cylinder means and first and second feed piston means positioned within said first and second feed cylinder means, respectively, wherein each of said first and second feed piston means is driven through at least an intake stroke and discharge stroke, comprising:

supplying product to said first feed cylinder means;

advancing said first feed piston means within said first feed cylinder means through a discharge stroke to discharge product from said first feed cylinder means;

retracting said second feed piston means in said second feed cylinder means to supply product to said second feed cylinder means;

advancing said second feed piston means in said second feed cylinder means to precompress the product within said second feed cylinder means;

inputting a variable magnitude relating to a predetermined pressure to be reached in said second feed cylinder means;

sensing a pressure magnitude related to the pressure within said second feed cylinder means during precompression of product within said second feed cylinder means;

comparing said pressure magnitude with said variable magnitude;

stopping further advancement of said second feed piston means in said second feed cylinder means when said pressure magnitude is substantially equal to said variable magnitude to complete precompression of the product;

initiating advancement of said second feed piston means in said second feed cylinder means before said first feed piston means in said first feed cylinder means completes its intake stroke.

* * * * *

UNITED STATES PATENT AND TRADEMARK OFFICE

CERTIFICATE OF CORRECTION

PATENT NO. : 5,141,408

DATED : August 25, 1992

INVENTOR(S) : Conrad et al.

It is certified that error appears in the above-identified patent and that said Letters Patent is hereby corrected as shown below:

Column 5, line 34, please delete "of" and insert therefor -- on --.

Column 8, line 54, please delete "52" and insert therefor -- 56 --.

Column 9, line 5, please delete "lug" and insert therefor -- 104 --.

Column 9, line 22, please delete "nave" and insert therefor -- have --.

Column 10, line 48, please delete "04" and insert therefor -- 204 --.

Column 11, line 64, please delete "reed" and insert therefor -- feed --.

Column 12, line 53, please delete "rime" and insert therefor -- time --.

UNITED STATES PATENT AND TRADEMARK OFFICE

CERTIFICATE OF CORRECTION

PATENT NO. :5,141,408
DATED :August 25, 1992
INVENTOR(S) :Conrad, et. al.

It is certified that error appears in the above-indentified patent and that said Letters Patent is hereby corrected as shown below:

Column 16, line 13, Claim 12, please delete "i" and insert therefor-- is --.

Signed and Sealed this

Twenty-eighth Day of September, 1993

*Attest:*

*Attesting Officer*

BRUCE LEHMAN

*Commissioner of Patents and Trademarks*